US010377154B2

(12) United States Patent
Van Beek et al.

(10) Patent No.: US 10,377,154 B2
(45) Date of Patent: Aug. 13, 2019

(54) PRINTING SYSTEM AND METHOD FOR TRANSPORTING A PRINT MEDIUM IN A PRINTING SYSTEM

(71) Applicant: Océ-Technologies B.V., Venlo (NL)

(72) Inventors: Albert M. Van Beek, Venlo (NL); Marcel J. H. M. Haenen, Venlo (NL); Hendrik K. Hogenhorst, Venlo (NL)

(73) Assignee: OCÉ-TECHNOLOGIES B.V., Venlo (NL)

( * ) Notice: Subject to any disclaimer, the term of this patent is extended or adjusted under 35 U.S.C. 154(b) by 49 days.

(21) Appl. No.: 15/475,787

(22) Filed: Mar. 31, 2017

(65) Prior Publication Data

US 2017/0203587 A1 Jul. 20, 2017

Related U.S. Application Data

(63) Continuation of application No. PCT/EP2015/072988, filed on Oct. 6, 2015.

(30) Foreign Application Priority Data

Oct. 8, 2014 (EP) ..... 14188139

(51) Int. Cl.

| | |
|---|---|
| ***B41J 13/00*** | (2006.01) |
| ***B41J 11/00*** | (2006.01) |
| ***B41J 13/22*** | (2006.01) |

(52) U.S. Cl.

CPC ..... *B41J 13/0009* (2013.01); *B41J 11/007* (2013.01); *B41J 11/0085* (2013.01); *B41J 11/0095* (2013.01); *B41J 13/226* (2013.01)

(58) Field of Classification Search

None

See application file for complete search history.

(56) References Cited

U.S. PATENT DOCUMENTS

| | | | | |
|---|---|---|---|---|
| 9,126,436 | B2 * | 9/2015 | Nagumo | B65H 7/02 |
| 2014/0210153 | A1 | 7/2014 | Nagumo et al. | |

* cited by examiner

*Primary Examiner* — Lamson D Nguyen

(74) *Attorney, Agent, or Firm* — Birch, Stewart, Kolasch & Birch, LLP

(57) ABSTRACT

The invention provides a printing system with a transport mechanism for transporting sheets. The transport mechanism comprises: a conveyor body for supporting and conveying a plurality of sheets a transport path; suction means, and especially fan means, for generating an under-pressure at or adjacent to the conveyor body to hold the sheets fixed in position on the conveyor body as it conveys the plurality of sheets along the transport path; and a controller for controlling or regulating operation of the suction means to adjust the under-pressure generated. The controller is configured to control operation of the suction means based on delivery of the plurality of sheets to the conveyor body and/or a change in the delivery of the sheets to the conveyor body. Further, the invention provides a corresponding method of transporting sheets of a print medium in a printing system.

14 Claims, 4 Drawing Sheets

PRINTING SYSTEM AND METHOD FOR TRANSPORTING A PRINT MEDIUM IN A PRINTING SYSTEM

CROSS REFERENCE TO RELATED APPLICATIONS

This application is a Continuation of PCT International Application No. PCT/EP2015/072988, filed on Oct. 6, 2015, which claims priority under 35 U.S.C. 119(a) to patent application Ser. No. 14/188,139.1, filed in Europe on Oct. 8, 2014, all of which are hereby expressly incorporated by reference into the present application.

FIELD OF THE INVENTION

The present invention relates to a printing system comprising a transport mechanism as well as a method for transporting a print medium, especially sheets of a print medium, in a printing system, such as an inkjet printing system. The invention also relates to a printing system that includes such a transport mechanism to improve and/or optimize productivity of the system.

BACKGROUND OF THE INVENTION

Deformations present within a sheet of a print medium in a printing system can be problematic for various reasons. Firstly, one or more such deformations can cause serious reliability problems in a printing system, such as an inkjet printing system, where there is only a small gap between a sheet transport mechanism and an image forming device or printing head of the printing system. If the sheet to be printed touches the image forming device or the printing head as a result of such a deformation, this can lead to print quality degradation and/or to a sheet jam in the machine. To achieve high print quality in an inkjet printing system, the distance between the printing heads and sheet to be printed should be kept small. Because of this small distance (print gap) the print heads are easily touched by the sheets as they pass. Accordingly, even small defects like dog ears, wrinkles, tears etc. can cause a so-called "head touch", which can degrade print quality, cause nozzle failure, or even sheet jams. Secondly, if the sheets of printed medium output from the printing system include any such deformations, this naturally compromises the quality of the output. Depending on the degree or extent of the deformations in the printed sheets, those sheets may need to be discarded and re-printed.

To address these issues, systems have been developed which employ a proofing device capable of identifying sheet deformations and rejecting sheets that contain such deformations. However, there are many sources of defects or errors that may degrade the productivity of a printing system. For example, sheets to be printed supplied to a printing machine may already contain various defects. Also, defects and wear within the machine can cause the sheets to become damaged. Changes in the environmental conditions can lead to deformation of the sheets as they are being processed, and inappropriate settings in the printing system, such as too much ink or a drying temperature that is too high, can also generate problems. In addition, a transport mechanism in the printing system will typically employ an under-pressure or suction for holding sheets of the print medium. If the under-pressure or suction is insufficient, deformations or wrinkles known as "cockling" can occur in the sheets, particularly during drying and/or fixing of an image after a printing operation. These influences or defects may also act in combination, thus making it very difficult to identify a root cause of a problem.

SUMMARY OF THE INVENTION

In view of the above, an object of the present invention is to provide a new and improved transport mechanism in a printing system method of transporting sheets of print medium in a printing system, such as an inkjet printer, and a printing system or printing machine including such a transport mechanism.

In accordance with the invention, a printing system comprising a transport mechanism having the features as recited in claim 1 and a method as recited in claim 9 are provided. Advantageous and/or preferred features of the invention are recited in the dependent claims.

According to one aspect, therefore, the present invention provides a transport mechanism for transporting sheets of a print medium in a printing system, the transport mechanism comprising:

- a conveyor body for supporting a plurality of sheets of a print medium thereon, wherein the conveyor body is movable to convey the sheets along a transport path in the printing system;
- suction means, especially fan means, for generating an under-pressure at or adjacent to the conveyor body to hold the plurality of sheets fixed in position thereon as the conveyor body conveys the plurality of sheets along the transport path; and
- a controller for controlling or regulating operation of the suction means to adjust the under-pressure generated, wherein the controller is configured to regulate or control operation of the suction means based on the delivery of the plurality of sheets to the conveyor body, especially based upon a change in the delivery of the sheets to the conveyor body.

In this way, the invention provides a device or mechanism for transporting sheets in a printing system which is designed to regulate the suction or under-pressure which holds the sheets on the conveyor body in such a manner that the suction or under-pressure generated changes as the delivery of the sheets to the conveyor body changes. Thus, the control of the suction means is desirably based on a rate of delivery of the plurality of sheets to the conveyor body, and especially a change in the rate of delivery of the sheets to the conveyor body. In particular, the present invention is able to take the time lag in generating an actual change of the under-pressure at the conveyor body into account such that the suction control is able to accurately match the timing of the change in circumstances on the conveyor body. Advantages also include longer service life of the suction means (e.g. longer fan life), a lower noise level, and a lower overall energy consumption.

In a preferred embodiment, the delivery of the plurality of sheets to the conveyor body (e.g. the rate of delivery), or a change in the (rate of) delivery of the sheets to the conveyor body, is determined or detected upstream of the conveyor body in the printing system. In this way, the controller is preferably configured to estimate a future coverage of the conveyor body with the plurality sheets and to regulate operation of the suction means so as to adjust the under-pressure according to the estimated future coverage of the conveyor body. Thus, the controller is typically configured to control operation of the suction means or fan means to adjust the under-pressure at or adjacent to the conveyor body before delivery of the plurality of sheets to the conveyor body. The transport mechanism of the present invention is therefore able to adapt the operation of the suction means to a sudden change, e.g. a sudden reduction, in the delivery of sheets of a print medium. For example, such a case may arise when the sheets in the printing system are monitored for defects. In the event that one or more sheets are found to have deformations or defects that would render those sheets unsuitable the system, those sheets may then be removed or ejected from the system, thereby leaving a gap in the series of sheets being delivered to the transport mechanism. Thus, the present invention is preferably designed to recognise such a changed delivery state or condition in advance and to adjust the suction means acting at the conveyor body in time to be suited or adapted to the changed conditions.

In a preferred embodiment, the conveyor body defines a carrier surface configured to support the plurality of sheets arranged in series on the conveyor body. The conveyor body includes holes or perforations which are at least partially covered by the plurality of sheets supported on the carrier surface, and these holes or perforations are configured and arranged to impart or communicate the under-pressure generated by the suction means to the carrier surface to hold the plurality of sheets fixed in position thereon. In this regard, the suction means may comprise fan means, such as a large centrifugal fan and/or one or more axial fan.

The fan means is typically configured and arranged to generate an air-flow through the carrier surface (e.g. through the holes or perforations) into the conveyor body to, in turn, generate the desired suction or under-pressure at the carrier surface to hold the print medium sheets fixed to the carrier surface. As the size or extent of the carrier surface is a fixed and known parameter of the transport mechanism, and the speed of the moveable conveyor body carrying the sheets is to be fixed or set by the controller, if the rate of delivery of the sheets to the conveyor body is accurately monitored, the controller may calculate and accurately determine the coverage of the conveyor body with the plurality of sheets at any given time. To this end, the controller will typically include a processor device for processing data and calculating the rate of delivery of the plurality of sheets to the conveyor body and/or a change in the rate of delivery of the sheets to the conveyor body. The processor device may also calculate or estimate a future coverage of the carrier surface of the conveyor body with the plurality sheets based on a determination or detection of a rate of delivery of the plurality of sheets to the conveyor.

In a particularly preferred embodiment, the conveyor body is provided as a drum member, which is configured to support the plurality of sheets around a periphery or a circumference thereof. That is, an outer periphery or circumference of the drum may form the carrier surface for the plurality of sheets, whereby the suction means or fan means is arranged to communicate with and to act upon a cavity enclosed by the drum. The drum is typically configured to rotate about a central axis to convey the sheets along the transport path. In an alternative embodiment, however, the conveyor body may be provided in the form of a belt member which is configured to support the plurality of sheets over a substantially planar outer surface thereof as the carrier surface. As is known for endless belt conveyors, the belt member may be configured to move on rollers to convey the sheets along the transport path, with at least one of those rollers being a driven roller.

In a preferred embodiment, the transport mechanism of the invention is provided in a drying and fixing unit of the printing system, such that the transport mechanism is designed for transporting the plurality of sheets of the print medium along the transport path for drying and fixing ink printed on the sheets downstream of the image forming unit of the printing system. As will be appreciated, however, the transport mechanism may also be arranged at other locations in a sheet transport path of the printing system. The drying and fixing unit in an inkjet printing system will typically include a drum-shaped conveyor body. Typically, a large centrifugal fan is used to provide sufficient under pressure to prevent deformation ("cockling") during drying of the sheets on the periphery of the drum. In the past, this fan has been operated at a fixed speed (frequency) setting based on meeting the pressure requirement for one sheet on the drum. As the drum fills with sheets during a print run, the under-pressure tends to rise to much higher levels than required resulting in unnecessary wear, high noise levels and unnecessary power consumption for most of the time. The transport mechanism of the present invention overcomes these problems by controlling and/or regulating the operation of the fan based on a determined or detected delivery of the sheets to the conveyor drum. If the present and expected sheet coverage is higher than a given threshold, the speed of the suction fan may be reduced by a desired amount.

Therefore, in a particularly preferred embodiment, the controller is configured to control an operating speed of the suction means, especially when provided as fan means (e.g. speed in rpm), to adjust the under-pressure generated. Preferably, the operating speed is constantly variable between a maximum and a minimum value. In this regard, the controller may be configured to increase the operating speed of the fan means based on a decrease in the rate of delivery of the plurality of sheets to the conveyor body and/or based on a lower estimate a future coverage of the conveyor body.

In a preferred embodiment, the controller is configured to control operation of the suction means (e.g. fan means) based on one or more parameters of the plurality of sheets selected from the group of: sheet size, sheet mass or sheet density, total ink coverage of each sheet, sheet type or shape, and the print medium. These attributes may be analysed by an incrementing sheet counter given a fixed time (up to 5 seconds) before a sheet reaches the conveyor body.

In a preferred embodiment, the controller is configured to control operation and/or movement of the conveyor body (e.g. speed of the conveyor body) based on the delivery of the plurality of sheets to the conveyor body and/or based on a change in the delivery of the sheets to the conveyor body.

In a particularly preferred embodiment, the sheet to be printed is a sheet of a print medium selected from the group comprised of: paper, polymer film, such as polyethylene (PE) film, polypropylene (PP) film, polyethylene terephthalate (PET) film, metallic foil, or a combination of two or more thereof.

According to a further aspect, the present invention provides a printing system comprising a transport mechanism for transporting a plurality of sheets of a print medium according to any one of the embodiments described above. As noted above, in a preferred form of the invention, the transport mechanism is provided in the drying and fixing unit of the printing system.

In a preferred embodiment, the printing system of the present invention includes an apparatus for detecting a defect, comprising:

a sensing unit including at least one first sensor device for sensing a surface geometry or topology of a sheet to be printed as the sheet travels on a transport path of the printing system and for generating data representative of that surface geometry or topology; and a processor device for processing the data from the first sensor device to detect and classify deformations in the surface geometry or topology of the sheet based on at least one predetermined criterion, with the at least one predetermined criterion optionally being adjustable or variable to suit operating conditions in the printing system.

Thus, the printing system includes an apparatus or device for sheet deformation measurement which is capable of sensing and measuring the surface shape of the sheet. By analysing the surface shape data of the sheet, relevant deformations or defects in the sheet and their properties can be detected or identified or extracted from the data. Furthermore, a classification can be made for each deformation or defect found within the sheet; for example, a type or shape classification (e.g. a "dog ear", curl, or waviness) and/or a size classification can be made. The data from the detection and classification of the deformations may then be used to assess or determine the suitability of the sheet for printing, to find a root cause or root defect in the printing system and/or to monitor printing system performance. Because the impact of a deformation or defect in a sheet on the printing system may vary depending on a range of different operating parameters or conditions in the system, the present invention is designed to modify or vary the at least one predetermined criterion depending on those operating parameters or conditions. The processor device will typically include a data storage unit for storing the data from the at least one first sensor device as well as the predetermined criteria.

In a preferred embodiment of the invention, the processor device is configured to detect and classify deformations in the surface geometry or topology of the sheet to determine whether a deformation renders the sheet unsuitable for printing; for example, because a detected deformation exceeds a threshold size or extent. The at least one predetermined criterion therefore preferably includes one or more of: a height of a deformation out of a plane of the sheet, and an area of a deformation in the plane of the sheet. In the event that the sheets have a defect, such as a curl, waviness or a dog-ear, these sheets increase the risks of a sheet jam, damage to the image forming unit or printing head, defects in the printed image, and so on. Therefore, the apparatus is designed to avoid such potential risks to increase the printing system productivity, lifetime, and print quality. Sheet deformation can often arise when loading the sheet into the printing system. By applying the at least one predetermined criterion for assessing the sheets on a first or single pass of the transport path, it is possible to supply only non-damaged or non-defective sheets to image forming unit, so that the above-mentioned risks can be minimized.

In a preferred embodiment, the apparatus includes a controller which controls further progress of the sheet on the transport path of the printing system depending upon the deformations in the surface geometry or topology of the sheet detected by the processor. The controller is configured to control and/or to operate a removal device for removing the sheet from the transport path of the printing system if and when the processor device identifies one or more deformations in the surface geometry or topology of the sheet that render the sheet unsuitable for printing. In this way, the invention is configured to prevent the printing system from being stopped or negatively impacted by a defective print medium sheet. When a sheet deformation or defect is found, the sheet can be removed from the transport path, e.g. via a removal device or ejector device that may switch or re-route the defective sheet to a reject tray. Such a removal device or ejector device operated by the controller is preferably part of the apparatus of the invention. Depending on the result of sheet form sensing, therefore, every sheet is assessed or analysed according to the at least one predetermined criterion (i.e. as a removal or ejection criterion) as to whether the sheet should be removed or ejected from the transport path. The removal or ejection criterion is typically defined in terms of a maximum or threshold height out of the plane of the sheet. If the sheet has higher defect than a given threshold value, the sheet will be removed or ejected. To prevent the printing system from experiencing a loss of print quality, or a nozzle failure or a sheet jam, the controller may thus operate to prevent a sheet in which one or more deformations or defects are detected from progressing to an image forming device or printing head unit of the system. On the other hand, if the apparatus determines a sheet to be free of deformations or defects or to have tolerable deformations or defects, it is allowed to progress to the image forming unit.

As discussed above, the removal or ejection of sheets of print medium from the transport path of the printing system as being unsuitable for printing or unsuitable for printed output creates gaps in the series of sheets being fed along the transport path of the system. As a result, the rate of delivery of the sheets to the transport mechanism of the invention, which may, for example, be provided in a drying and fixing unit of the system, is changed or modified by removal of defective sheets. The controller is therefore configured or adapted to control the suction means of transport mechanism to adjust the under-pressure applied to the conveyor body of the transport mechanism to the modified delivery rate of the plurality of sheets that results from the removal of the defective sheets.

The printing system may be designed for a single-pass of the print medium sheets through an image forming device or for multi-pass image formation. In a preferred embodiment, the sensor device of the apparatus is configured and arranged to sense the surface geometry or topology of the sheet when the sheet is on a first pass or simplex pass of the transport path towards an image forming device or a printing head unit of the printing system. In the event the printing system employs multi-pass image formation, the sensor device of the apparatus may be configured and arranged to sense the surface geometry or topology of the sheet each time the sheet makes a pass of the transport path towards the image forming device or printing head unit of the printing system. For example, in a duplex-pass printing system, the sensor device is configured and arranged to sense a surface geometry or topology of the sheet both on the first pass or simplex pass as well as on the second pass or duplex pass.

The moment in time at which a sheet deformation or defect appears within the printing process and the shape and/or the size of the deformation or defect can help to determine the cause of that defect. For example, if a pack of paper print medium sheets is dropped before being fed into a printing system, the associated defects in the paper will appear directly at a simplex pass proofing. In such a case, where a sheet is identified as having a dog-eared corner, it is highly probable that many subsequent sheets will also have a dog ear at one of the corners of the sheet. It will be appreciated, however, that the sheets to be printed can also be damaged or acquire one or more defects during the printing process on a simplex pass through the system. For example, sheets can develop very specific waviness deformations due to humidity variation that can readily be distinguished from dog ears and curl defects. On the other hand, if the duplex sheet transport mechanism in the printing system is defective, the sheets may become damaged during the duplex pass. In such a case, the presence of a defect in the duplex pass may be confirmed by the simplex pass sheet analysis showing that the sheet was not damaged at that time. For this reason, sheet form sensing on the duplex pass also helps to decrease the above-mentioned risks of sheet jam, damage to the image forming unit or printing head, defects in the printed image, and so on.

Significantly, however, the impact of removing or rejecting a sheet on the duplex pass can be higher than removing or rejecting a sheet on the simplex pass. Because sheet removal on the duplex pass results in a missing page in the output, duplex sheets following a removed or rejected sheet also need to be removed to ensure that the printed images are in a correct order in the final output stock. Due to this fact, the impact of sheet removal on productivity is multiplied in the duplex pass. If a user prefers higher productivity, sheets should be removed or rejected as little as possible on the duplex pass, to the extent that this does not cause serious problems. Such different requirements or criteria for removal or ejection between the simplex and the duplex passes of the transport path may, for example, be satisfied by setting a larger threshold value for a removal or ejection criterion in the duplex pass than in the simplex pass.

In a particularly preferred embodiment, therefore, the at least one predetermined criterion is adjustable or variable depending upon one or more of: a material of the sheet to be printed, an operating mode of the printing system, a position of a deformation on the sheet, a shape or type of a deformation, and/or whether the sheet is on a simplex pass or a duplex pass of the transport path. Because the likelihood of sheet damage or deformation occurring on the duplex pass typically depends on the material or print medium of the sheet, it is possible to set a unique simplex and duplex threshold for each material or print medium type. Furthermore, it is possible that the printing system has different modes of operation, such as a productivity mode or a print-quality mode, each of which may then have different removal or ejection criteria. In addition, it is possible to vary the predetermined criterion based on defect location within the sheet or based on the type of defect. In this regard, it will be noted that a higher threshold value for trailing edge defects and/or for waviness on a side edge may be provided or tolerated because these are less likely to cause a sheet jam.

As it is desired to prevent defective sheets from reaching the printing heads of an image forming unit in the printing system, the removal device is typically arranged to remove the sheet from the transport path upstream of the image forming unit or printing head unit of the system. To this end, the sensing unit should be spaced a sufficient distance from the image forming unit; i.e. space is required to remove a sheet containing deformations from the transport path. The sensing unit may therefore be provided as a "sentry unit" for location in the transport path of the printing system before (i.e. upstream of) the image forming unit to allow the removal device or ejector device to be positioned between the sentry unit and the image forming unit. The minimum distance along the transport path between the sentry unit and the image forming unit may be determined by a sheet length and the processing time needed to detect and classify deformations.

For example, a long sheet could have a defect on the trailing edge. The processor device will require time to process the data generated by the first sensor device and detect a deformation at the trailing edge after this has passed the measurement position. Thus, a leading edge of the sheet should not have passed the removal device at the moment of sensing the trailing edge of the sheet in order to ensure that a removal of the sheet upstream of the image forming unit is still possible. In this regard, a sheet transport mechanism for transporting or conveying the sheets to be printed between the sentry unit and the image forming unit may be different to a transport mechanism employed by each of the sensing unit and the image forming unit. Specifically, this sheet transport mechanism in between may be optimized for a reliable sheet removal or ejection.

In a particularly preferred embodiment, the apparatus further comprises at least one second sensor device located downstream of the first sensor device, and typically upstream of and/or in an image forming unit or printing head unit of the printing system, for sensing a surface geometry or a topology of a sheet to provide feedback data or correlation data to the processor device for comparison with the data from the at least one first sensor device. As will be appreciated, the sheet transport conditions can never be reproduced with one-hundred percent accuracy at the sensing unit and this limits the accuracy of the sheet deformation analysis or measurement by the apparatus. By adding a second sheet shape measurement or sensor device at the image forming unit, the accuracy can be tested and improved by using feedback. The second sensor device or measuring device at the image forming unit does not necessarily have to be identical to the first sensor device. A more limited system, e.g. a single point measurement device, could be used to provide feedback for a two-dimensional (2D) profile measuring device.

According to yet another aspect, the invention provides a method of transporting sheets of print medium in a printing system, comprising:

- supporting a plurality of sheets of a print medium on a conveyor body that is movable to convey the sheets along a transport path in the printing system;
- operating a suction means to generate an under-pressure at or adjacent the conveyor body to hold the plurality of sheets fixed in position thereon as the conveyor body conveys the plurality of sheets along the transport path;
- controlling operation of the suction means to adjust the under-pressure generated, whereby the operation of the suction means is controlled based on a rate of delivery of the plurality of sheets to the conveyor body and/or based on a change in the rate of delivery of the sheets to the conveyor body.

In a preferred embodiment, the controlling step comprises determining the rate of delivery of the plurality of sheets to the conveyor body, or the change in that rate of delivery of the sheets to the conveyor body, upstream of the conveyor body in the printing system. In this way, the controlling step comprises estimating a future coverage of the conveyor body with the plurality sheets and controlling operation of the suction means (e.g. controlling a speed of a fan means) to adjust the under-pressure according to the estimated future coverage, and particularly before arrival or delivery of the plurality of sheets to the conveyor body.

In a preferred embodiment, the method further comprises the step of controlling movement, and especially speed, of the conveyor body based upon the rate of delivery of the plurality of sheets to the conveyor body and/or the change in the rate of delivery of the sheets to the conveyor body. As noted above, the conveyor body is preferably provided as a drum member configured to support the plurality of sheets on a periphery or a circumference thereof. To this end, an inner or an outer periphery or circumference of the drum member may be configured to carry the plurality of sheets, and the drum may move in rotation about a central axis to convey the sheets along the transport path. Alternatively, however, the conveyor body may comprise a belt or a table.

In a preferred embodiment, the step of controlling operation of the suction means is based upon one or more parameters of the plurality of sheets, those parameters selected from the group including: sheet size, sheet mass, sheet density, total ink coverage of each sheet, sheet type or shape, and type of print medium.

BRIEF DESCRIPTION OF THE DRAWINGS

For a more complete understanding of the invention and the advantages thereof, exemplary embodiments of the invention are explained in more detail in the following description with reference to the accompanying drawing figures, in which like reference characters designate like parts and in which.

The accompanying drawings are included to provide a further understanding of the present invention and are incorporated in and constitute a part of this specification. The drawings illustrate particular embodiments of the invention and together with the description serve to explain the principles of the invention. Other embodiments of the invention and many of the attendant advantages of the invention will be readily appreciated as they become better understood with reference to the following detailed description.

It will be appreciated that common and/or well understood elements that may be useful or necessary in a commercially feasible embodiment are not necessarily depicted in order to facilitate a more abstracted view of the embodiments. The elements of the drawings are not necessarily illustrated to scale relative to each other. It will further be appreciated that certain actions and/or steps in an embodiment of a method may be described or depicted in a particular order of occurrences while those skilled in the art will understand that such specificity with respect to sequence is not actually required. It will also be understood that the terms and expressions used in the present specification have the ordinary meaning as is accorded to such terms and expressions with respect to their corresponding respective areas of inquiry and study, except where specific meanings have otherwise been set forth herein.

DETAILED DESCRIPTION OF EMBODIMENTS

Figure 1:
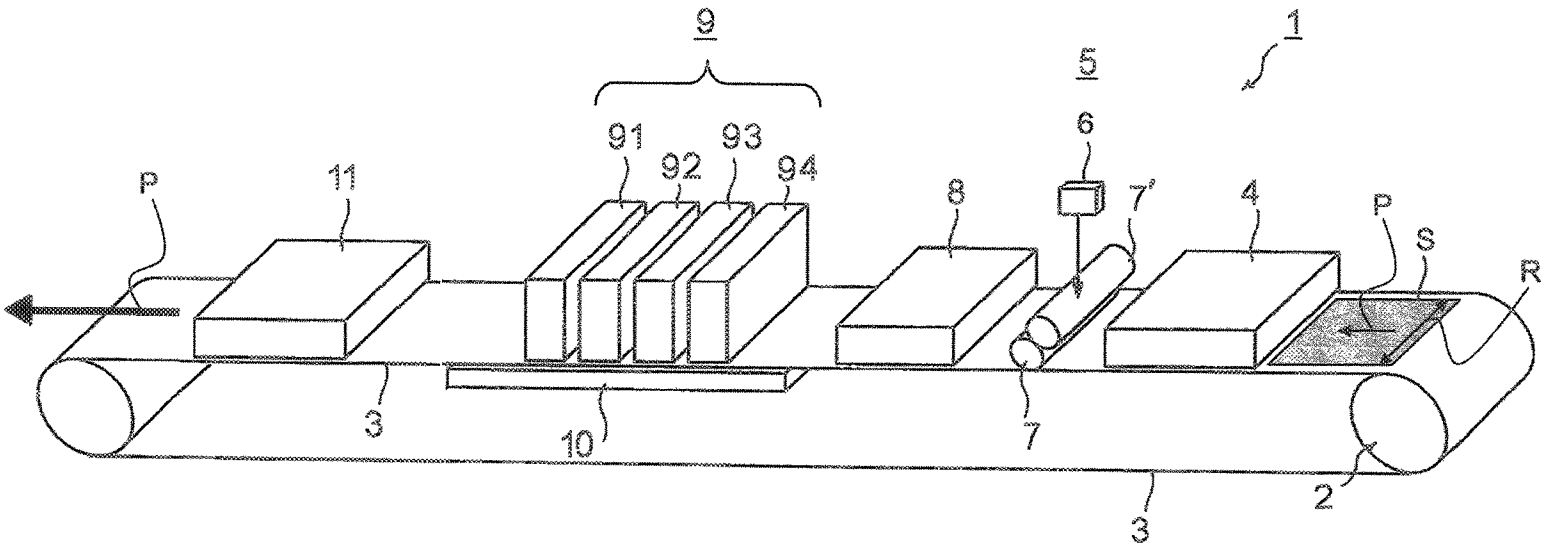
FIG. 1 is a schematic side view of part of a printing system according to an embodiment of the invention.

With reference to FIG. 1 of the drawings, a portion of an inkjet printing system 1 according to a preferred embodiment of the invention is shown. FIG. 1 illustrates in particular the following parts or steps of the printing process in the inkjet printing system 1: media pre-treatment, image formation, drying and fixing and optionally post treatment. Each of these will be discussed briefly below.

FIG. 1 shows that a sheet S of a receiving medium or print medium, in particular a machine-coated print medium, is transported or conveyed along a transport path P of the system 1 with the aid of transport mechanism 2 in a direction indicated by arrows P. The transport mechanism 2 according to this embodiment may comprise a driven belt system having one or more endless belt 3. Alternatively, the belt(s) 3 may be exchanged for one or more drums 3. The transport mechanism 2 may be suitably configured depending on the requirements of the sheet transport in each step of the printing process (e.g. sheet registration accuracy) and may hence comprise multiple driven belts and/or multiple drums 3, 3'. For proper conveyance of the sheets S of the receiving medium or print medium, the sheets S should be fixed to or held by the transport mechanism 2. The manner of such fixation is not limited but typically includes vacuum fixation (e.g. via suction or under-pressure) although electrostatic fixation and/or mechanical fixation (e.g. clamping) may also be employed.

Media Pre-Treatment

To improve spreading and pinning (i.e. fixation of pigments and water-dispersed polymer particles) of the ink on the print medium, in particular on slow absorbing media, such as machine-coated media, the print medium may be pre-treated, i.e. treated prior to the printing of an image on the medium. The pre-treatment step may comprise one or more of the following:

(i) pre-heating of the print medium to enhance spreading of the ink used on the print medium and/or to enhance absorption into the print medium of the ink used;

(ii) primer pre-treatment for increasing the surface tension of print medium in order to improve the wettability of the print medium by the ink used and to control the stability of the dispersed solid fraction of the ink composition, i.e. pigments and dispersed polymer particles; (N.B. primer pre-treatment can be performed in a gas phase, e.g. with gaseous acids such as hydrochloric acid, sulphuric acid, acetic acid, phosphoric acid and lactic acid, or in a liquid phase by coating the print medium with a pre-treatment liquid. A pre-treatment liquid may include water as a solvent, one or more co-solvents, additives such as surfactants, and at least one compound selected from a polyvalent metal salt, an acid and a cationic resin); and (iii) corona or plasma treatment.

FIG. 1 illustrates that the sheet S of print medium may be conveyed to and passed through a first pre-treatment module 4, which module may comprise a preheater, (e.g. a radiation heater), a corona/plasma treatment unit, a gaseous acid treatment unit or a combination of any of these. Subsequently, a predetermined quantity of the pre-treatment liquid may optionally be applied on a surface of the print medium via a pre-treatment liquid applying device 5. Specifically, the pre-treatment liquid is provided from a storage tank 6 to the pre-treatment liquid applying device 5, which comprises double rollers 7, 7'. A surface of the double rollers 7, 7' may be covered with a porous material, such as sponge. After providing the pre-treatment liquid to auxiliary roller 7' first, the pre-treatment liquid is transferred to main roller 7, and a predetermined quantity is applied onto the surface of the print medium. Thereafter, the coated printing medium (e.g. paper) onto which the pre-treatment liquid was applied may optionally be heated and dried by a dryer device 8, which comprises a dryer heater installed at a position downstream of the pre-treatment liquid applying device 5 in order to reduce the quantity of water content in the pre-treatment liquid to a predetermined range. It is preferable to decrease the water content in an amount of 1.0 weight % to 30 weight % based on the total water content in the pre-treatment liquid provided on the print medium sheet S. To prevent the transport mechanism 2 from being contaminated with pre-treatment liquid, a cleaning unit (not shown) may be installed and/or the transport mechanism 2 may include a plurality of belts or drums 3, 3', as noted above. The latter measure avoids or prevents contamination of other parts of the printing system 1, particularly of the transport mechanism 2 in the printing region.

It will be appreciated that any conventionally known methods can be used to apply the pre-treatment liquid. Specific examples of an application technique include: roller coating (as shown), ink-jet application, curtain coating and spray coating. There is no specific restriction in the number of times the pre-treatment liquid may be applied. It may be applied just one time, or it may be applied two times or more. An application twice or more may be preferable, as cockling of the coated print medium can be prevented and the film formed by the surface pre-treatment liquid will produce a uniform dry surface with no wrinkles after application twice or more. A coating device 5 that employs one or more rollers 7, 7' is desirable because this technique does not need to take ejection properties into consideration and it can apply the pre-treatment liquid homogeneously to a print medium. In addition, the amount of the pre-treatment liquid applied with a roller or with other means can be suitably adjusted by controlling one or more of: the physical properties of the pre-treatment liquid, the contact pressure of the roller, and the rotational speed of the roller in the coating device. An application area of the pre-treatment liquid may be only that portion of the sheet S to be printed, or an entire surface of a print portion and/or a non-print portion. However, when the pre-treatment liquid is applied only to a print portion, unevenness may occur between the application area and a non-application area caused by swelling of cellulose contained in coated printing paper with water from the pre-treatment liquid followed by drying. From a view-point of uniform drying, it is thus preferable to apply a pre-treatment liquid to the entire surface of a coated printing paper, and roller coating can be preferably used as a coating method to the whole surface. The pre-treatment liquid may be an aqueous liquid.

Corona or plasma treatment may be used as a pre-treatment step by exposing a sheet of a print medium to corona discharge or plasma treatment. In particular, when used on media such as polyethylene (PE) films, polypropylene (PP) films, polyethylene terephthalate (PET) films and machine coated media, the adhesion and spreading of the ink can be improved by increasing the surface energy of the medium. With machine-coated media, the absorption of water can be promoted which may induce faster fixation of the image and less puddling on the print medium. Surface properties of the print medium may be tuned by using different gases or gas mixtures as medium in the corona or plasma treatment. Examples of such gases include: air, oxygen, nitrogen, carbon dioxide, methane, fluorine gas, argon, neon, and mixtures thereof. Corona treatment in air is most preferred.

Image Formation

When employing an inkjet printer loaded with inkjet inks, the image formation is typically performed in a manner whereby ink droplets are ejected from inkjet heads onto a print medium based on digital signals. Although both single-pass inkjet printing and multi-pass (i.e. scanning) inkjet printing may be used for image formation, single-pass inkjet printing is preferable as it is effective to perform high-speed printing. Single-pass inkjet printing is an inkjet printing method with which ink droplets are deposited onto the print medium to form all pixels of the image in a single passage of the print medium through the image forming device, i.e. beneath an inkjet marking module.

Referring to FIG. 1, after pre-treatment, the sheet S of print medium is conveyed on the transport belt 3 to an image forming device or inkjet marking module 9, where image formation is carried out by ejecting ink from inkjet marking device 91, 92, 93, 94 arranged so that a whole width of the sheet S is covered. That is, the image forming device 9 comprises an inkjet marking module having four inkjet marking devices 91, 92, 93, 94, each being configured and arranged to eject an ink of a different colour (e.g. Cyan, Magenta, Yellow and Black). Such an inkjet marking device 91, 92, 93, 94 for use in single-pass inkjet printing typically has a length corresponding to at least a width of a desired printing range R (i.e. indicated by the double-headed arrow on sheet S), with the printing range R being perpendicular to the media transport direction along the transport path P.

Figure 2:
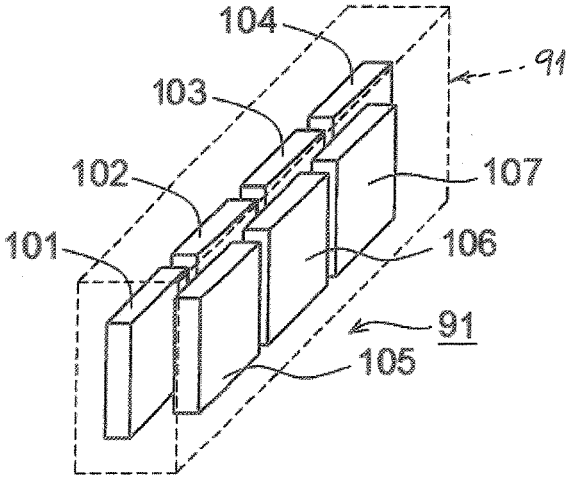
FIG. 2 is a schematic perspective view of an image forming device in the printing system of FIG. 1.
Figure 3A:
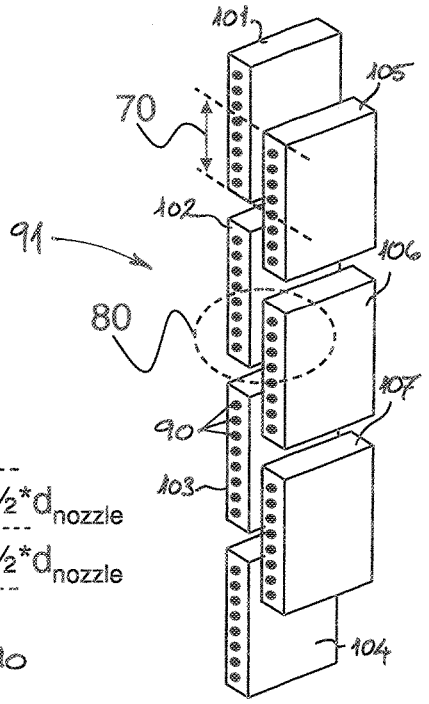
FIG. 3A is a schematic perspective underside view of printing heads in the image forming device of FIG. 2.
Figure 3B:
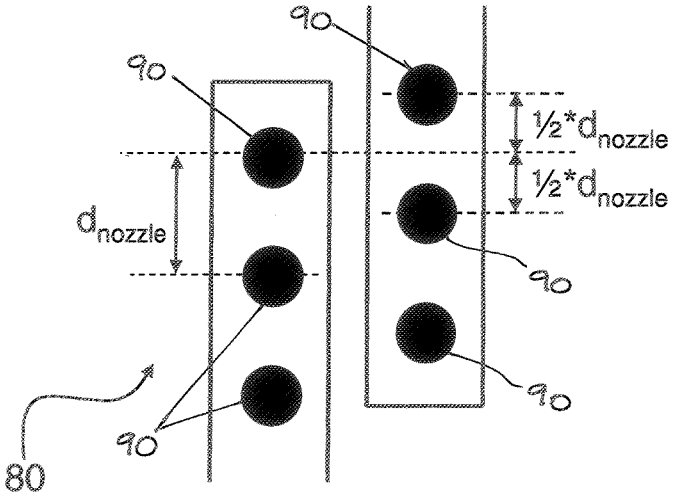
FIG. 3B is a detailed view of the printing heads in the image forming device of FIG. 2 and FIG. 3A.

Each inkjet marking device 91, 92, 93, 94 may have a single print head having a length corresponding to the desired printing range R. Alternatively, as shown in FIG. 2, the inkjet marking device 91 may be constructed by combining two or more inkjet heads or printing heads 101-107, such that a combined length of individual inkjet heads covers the entire width of the printing range R. Such a construction of the inkjet marking device 91 is termed a page wide array (PWA) of print heads. As shown in FIG. 2, the inkjet marking device 91 (and the others 92, 93, 94 may be identical) comprises seven individual inkjet heads 101-107 arranged in two parallel rows, with a first row having four inkjet heads 101-104 and a second row having three inkjet heads 105-107 arranged in a staggered configuration with respect to the inkjet heads 101-104 of the first row. The staggered arrangement provides a page-wide array of inkjet nozzles 90, which nozzles are substantially equidistant in the length direction of the inkjet marking device 91. The staggered configuration may also provide a redundancy of nozzles in an area O where the inkjet heads of the first row and the second row overlap. (See in FIG. 3A). The staggering of the nozzles 90 may further be used to decrease an effective nozzle pitch d (and hence to increase print resolution) in the length direction of the inkjet marking device 91. In particular, the inkjet heads are arranged such that positions of the nozzles 90 of the inkjet heads 105-107 in the second row are shifted in the length direction of the inkjet marking device 91 by half the nozzle pitch d, the nozzle pitch d being the distance between adjacent nozzles 90 in an inkjet head 101-107. (See FIG. 3B, which shows a detailed view of 80 in FIG. 3A). The nozzle pitch d of each head is, for example, about 360 dpi, where "dpi" indicates a number of dots per 2.54 cm (i.e. dots per inch). The resolution may be further increased by using more rows of inkjet heads, each of which are arranged such that the positions of the nozzles of each row are shifted in the length direction with respect to the positions of the nozzles of all other rows.

In the process of image formation by ejecting ink, an inkjet head or a printing head employed may be an on-demand type or a continuous type inkjet head. As an ink ejection system, an electrical-mechanical conversion system (e.g. a single-cavity type, a double-cavity type, a bender type, a piston type, a shear mode type, or a shared wall type) or an electrical-thermal conversion system (e.g. a thermal inkjet type, or a Bubble Jet® type) may be employed. Among them, it is preferable to use a piezo type inkjet recording head which has nozzles of a diameter of 30 μm or less in the current image forming method.

The image formation via the inkjet marking module 9 may optionally be carried out while the sheet S of print medium is temperature controlled. For this purpose, a temperature control device 10 may be arranged to control the temperature of the surface of the transport mechanism 2 (e.g. belt or drum 3) below the inkjet marking module 9. The temperature control device 10 may be used to control the surface temperature of the sheet S within a predetermined range, for example in the range of 30° C. to 60° C. The temperature control device 10 may comprise one or more heaters, e.g. radiation heaters, and/or a cooling means, for example a cold blast, in order to control and maintain the surface temperature of the print medium within the desired range. During and/or after printing, the print medium is conveyed or transported downstream through the inkjet marking module 9.

Drying and Fixing

After an image has been formed on the print medium, the printed ink must be dried and the image must be fixed on the print medium. Drying comprises evaporation of solvents, and particularly those solvents that have poor absorption characteristics with respect to the selected print medium.

FIG. 1 of the drawings schematically shows a drying and fixing unit 11, which may comprise one or more heater, for example a radiation heater. After an image has been formed on the print medium sheet S, the sheet S is conveyed to and passed through the drying and fixing unit 11. The ink on the sheet S is heated such that any solvent present in the printed image (e.g. to a large extent water) evaporates. The speed of evaporation, and hence the speed of drying, may be enhanced by increasing the air refresh rate in the drying and fixing unit 11. Simultaneously, film formation of the ink occurs, because the prints are heated to a temperature above the minimum film formation temperature (MFT). The residence time of the sheet S in the drying and fixing unit 11 and the temperature at which the drying and fixing unit 11 operates are optimized, such that when the sheet S leaves the drying and fixing unit 11 a dry and robust image has been obtained.

As described above, the transport mechanism 2 in the fixing and drying unit 11 may be separate from the transport mechanism 2 of the pre-treatment and printing parts or sections of the printing system 1 and may comprise a belt and/or a drum. Preferably, the transport mechanism 2 in the fixing and drying unit 11 comprises a drum and includes a device, such as one or more fan, especially a centrifugal fan, for generating an under-pressure or suction for holding a plurality of sheets of print medium in contact with an outer periphery of the drum 3. Further details of this embodiment of the transport mechanism 2 in the fixing and drying unit 11 will be described later.

Post Treatment

To improve or enhance the robustness of a printed image or other properties, such as gloss level, the sheet S may be post treated, which is an optional step in the printing process. For example, in a preferred embodiment, the printed sheets S may be post-treated by laminating the print image. That is, the post-treatment may include a step of applying (e.g. by jetting) a post-treatment liquid onto a surface of the coating layer, onto which the ink has been applied, so as to form a transparent protective layer over the printed recording medium. In the post-treatment step, the post-treatment liquid may be applied over the entire surface of an image on the print medium or it may be applied only to specific portions of the surface of an image. The method of applying the post-treatment liquid is not particularly limited, and may be selected from various methods depending on the type of the post-treatment liquid. However, the same method as used in coating the pre-treatment liquid or an inkjet printing method is preferable. Of these, an inkjet printing method is particularly preferable in view of: (i) avoiding contact between the printed image and the post-treatment liquid applicator; (ii) the construction of an inkjet recording apparatus used; and (iii) the storage stability of the post-treatment liquid. In the post-treatment step, a post-treatment liquid containing a transparent resin may be applied on the surface of a formed image so that a dry adhesion amount of the post-treatment liquid is 0.5 $g/m^2$ to 10 $g/m^2$, preferably 2 $g/m^2$ to 8 $g/m^2$, thereby to form a protective layer on the recording medium. If the dry adhesion amount is less than 0.5 $g/m^2$, little or no improvement in image quality (image density, colour saturation, glossiness and fixability) may be obtained. If the dry adhesion amount is greater than 10 $g/m^2$, on the other hand, this can be disadvantageous from the view-point of cost efficiency, because the dryness of the protective layer degrades and the effect of improving the image quality is saturated.

As a post-treatment liquid, an aqueous solution comprising components capable of forming a transparent protective layer over the print medium sheet S (e.g. a water-dispersible resin, a surfactant, water, and other additives as required) is preferably used. The water-dispersible resin in the post-treatment liquid preferably has a glass transition temperature (Tg) of −30° C. or higher, and more preferably in the range of −20° C. to 100° C. The minimum film forming temperature (MFT) of the water-dispersible resin is preferably 50° C. or lower, and more preferably 35° C. or lower. The water-dispersible resin is preferably radiation curable to improve the glossiness and fixability of the image. As the water-dispersible resin, for example, any one or more of an acrylic resin, a styrene-acrylic resin, a urethane resin, an acryl-silicone resin, a fluorine resin or the like, is preferably employed. The water-dispersible resin can be suitably selected from the same materials as that used for the inkjet ink. The amount of the water-dispersible resin contained, as a solid content, in the protective layer is preferably 1% by mass to 50% by mass. The surfactant used in the post-treatment liquid is not particularly limited and may be suitably selected from those used in the inkjet ink. Examples of the other components of the post-treatment liquid include antifungal agents, antifoaming agents, and pH adjustors.

Hitherto, the printing process was described such that the image formation step was performed in-line with the pre-treatment step (e.g. application of an (aqueous) pre-treatment liquid) and a drying and fixing step, all performed by the same apparatus, as shown in FIG. 1. However, the printing system 1 and the associated printing process are not restricted to the above-mentioned embodiment. A system and method are also contemplated in which two or more separate machines are interconnected through a transport mechanism 2, such as a belt conveyor 3, drum conveyor or a roller, and the step of applying a pre-treatment liquid, the (optional) step of drying a coating solution, the step of ejecting an inkjet ink to form an image and the step or drying an fixing the printed image are performed separately. Nevertheless, it is still preferable to carry out the image formation with the above defined in-line image forming method and printing system 1.

Figure 4:
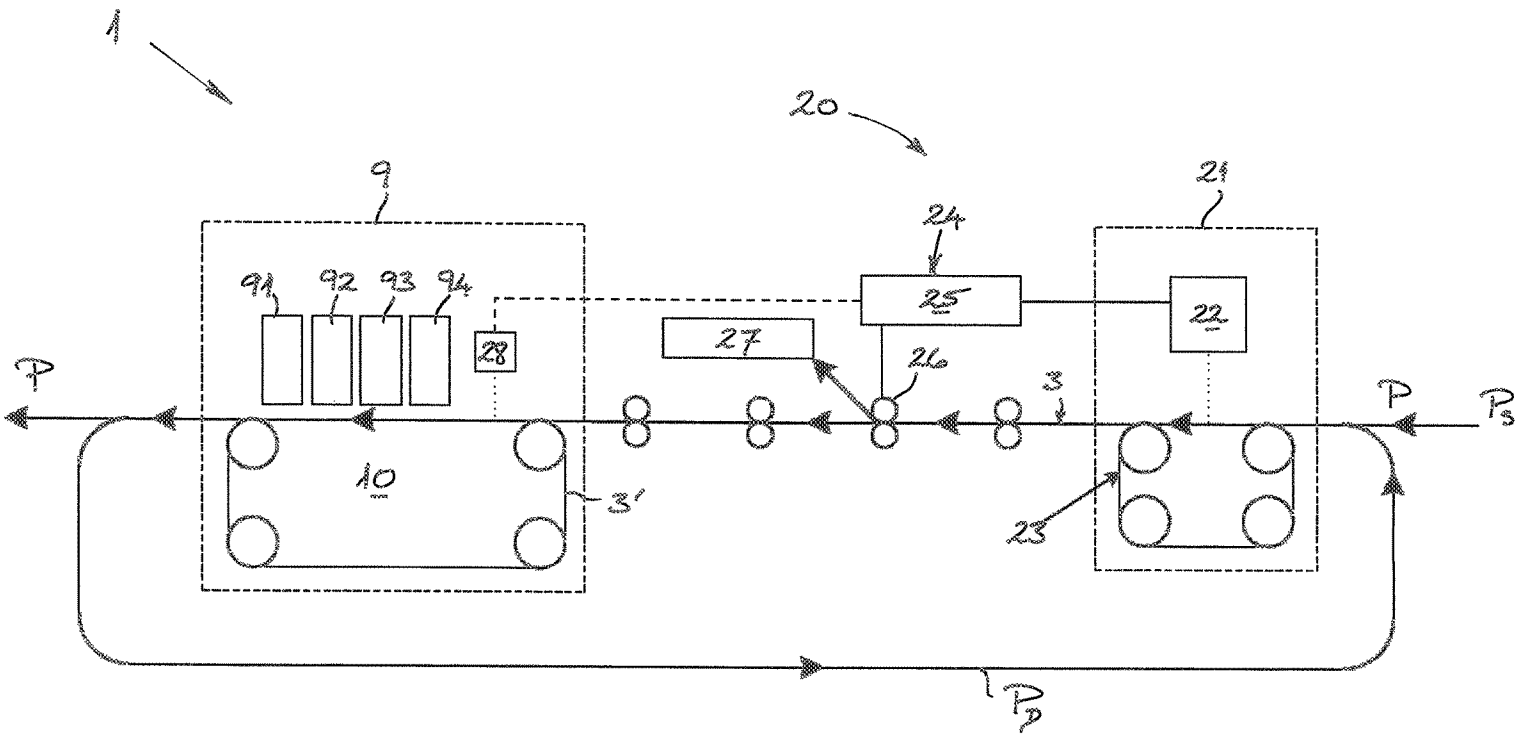
FIG. 4 is a schematic side view of a printing system with a defect detection system according to an embodiment of the invention.

With reference now to FIG. 4 of the drawings, the inkjet printing system 1 according to the preferred embodiment of the invention is shown to include an apparatus 20 for detecting defects in the printing system 1, and particularly for identifying and for classifying deformations D in the sheets S of print medium when the sheets S are on the transport path P of the printing system 1. In this particular embodiment, the apparatus 20 comprises a sensing unit 21, which processes the sheets S on the transport path P before those sheets S enter the image forming device 9. In this regard, it will be noted that the printing system 1 in FIG. 4 has a transport path P which includes both a simplex path $P_S$ and a duplex path $P_D$ and the sensing unit 21 of the apparatus 20 is arranged such that sheets S input on the simplex path $P_S$ and also returning on the duplex path $P_D$ all pass via the sensing unit 21.

At least one first sensor device 22 in the form of an optical sensor, such as a laser scanner, is provided within the sensing unit 21 for sensing the surface geometry or topology of the sheets S as they travel on a first pass or a second pass along the transport path P. The laser scanner or optical sensor device 22 generates digital image data I of the three-dimensional surface geometry or topology of each sheet S sensed or scanned. When performing the sensing or measuring of the surface geometry or topology of the sheets S on the transport path P of printing system 1 with the first sensor device(s) 22, it is highly desirable for the purposes of accuracy and reliability that the sheets S are transported or conveyed in the sensing unit 21 in substantially the same manner as those sheets S are later transported in the image forming unit or marking module 9. To this end, the sensing unit 21 includes a sheet conveyor mechanism 23 that simulates the sheet transport conditions provided by the transport mechanism 3' within the image forming unit 9. In this regard, both the conveyor mechanism 23 and the transport mechanism 3' include a belt transport device with vacuum sheet-holding pressure, as seen in FIG. 4.

The sheet topology data from the first sensor device 22 is then transmitted (e.g. either via a cable connection or wirelessly) to a controller 24 which includes a processor device 25 for processing and analysing the digital image data I to detect and to classify any defect or deformation D in the surface geometry or topology of each sheet S sensed or scanned. The sensing unit 21 is thus arranged to scan the sheets S for detecting and measuring any deformations or defects D before the sheets S enter the image forming device or inkjet marking module 9. In this way, if the processor device 25 determines that a sheet S on the transport path P includes a defect or deformation D that would render the sheet unsuitable for printing, the controller 24 is configured to prevent the sheet S from progressing to the inkjet marking module 9. The sensing unit 21 comprising the first sensor device(s) 22 is therefore desirably provided as a separate sentry unit positioned on the transport path P sufficiently upstream of the marking module 9. The controller 24 and processor device 25 may be integrated within the sentry unit 21 or they may be separately or remotely located.

Figure 5:
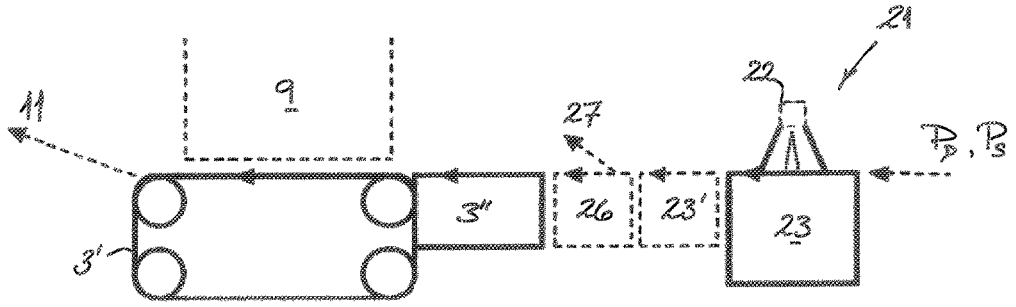
FIG. 5 is a schematic side view showing more detail of a printing system with a defect detection system in the duplex transport path according to an embodiment of the invention.

Referring also to FIG. 5, some additional elements of the printing system 1 and the apparatus 20 are illustrated. For example, located immediately downstream of the first sensor device 22 in the sentry unit 21 is an additional sheet conveyor 23' that rotates and translates each sheet S on the transport path P before the sheet S passes removal device 26. It will also be noted that the printing system 1 includes a sheet registration entry unit 3" for regulating a position or orientation of each sheet S on the transport path P as the sheet S enters the image forming device 9.

Print System Control

With reference again to FIGS. 4 and 5, after the image data I has been analysed by the processor 25 and the defects or deformations D within the sheet S have been extract and classified accordingly, the controller 24 may transmit a control signal (e.g. either via cable or wirelessly) to a removal device or ejector device 26 for regulating the transport or conveyance of the sheets S to the image forming device or inkjet marking module 9. In particular, if the sheet S has been determined by the processor 25 to include one or more deformations D with a size or extent above a predetermined threshold sufficient to render the sheet unsuitable for printing, the controller 24 is configured to control or operate the removal device 26 to remove or eject the sheet S from the transport path P to a reject tray 27. The controller 24 controls sheet removal or rejection via the removal device 26 on the basis of a sheet form detection result from the processor device 25 compared with at least one predetermined rejection criterion. This rejection criterion is typically defined by a maximum allowable height H of a detected deformation D out of the plane of the sheet S because in an inkjet printing system 1 the passage of the sheet S through the narrow print gap under the printing heads 101-107 is most critical. In particular, while a larger print gap in inkjet applications provides robustness against sheet deformations or sheet jams, it results in a lower print quality, so the print gap is often kept as small as practicable.

In this way, sheet jams within the print module or image forming device 9 may be avoided when sheets S are found to contain too much deformation. The removal device 26 located between the sentry unit 21 and the inkjet marking module 9 can employ different means optimized for redirecting the sheets S from the transport path P towards the reject tray 27. In this particular embodiment, rollers are used. In principle, control of the removal device or ejector device 26 by the controller 24 can be based solely upon one predetermined criterion to perform its job, such as a maximum allowable deformation height or size. However, information gathered on deformation of the sheet S may also be used for statistical purposes to determine media run-ability. For statistical purposes more information is generally useful, such as a number of the deformed areas or defects D present within a sheet S, the area A of each defect D, etc. The classification data may be stored in, and later retrieved from, the controller 24 for further analysis. The predetermined rejection criterion in the apparatus 20 is varied depending on the operating parameters or conditions of the printing system 1, e.g. one or more of: a material of the sheet S; an operating mode of the printing system (e.g. a high productivity mode or a high print-quality mode); a position of the deformation D on the sheet S (e.g. leading edge, trailing edge, middle of sheet), a shape or type of the deformation D (e.g. a dog-ear, waviness, or a curl), and/or whether the sheet S is on a simplex pass or a duplex pass of the transport path P.

In this regard, the impact of removing or ejecting a sheet S on the duplex pass is often higher than removing or rejecting the sheet S on the simplex pass because sheet removal on the duplex pass results in a missing page in the output, and duplex sheets following a removed or rejected sheet also need to be removed to ensure that the printed images are in the correct order in the final output. Thus, it is possible that the printing system 1 may have different modes of operation, such as a high-productivity mode (e.g. with higher rejection threshold criterion on the duplex pass) or a high-print-quality mode (e.g. with lower rejection threshold criterion on the duplex pass). Also, the likelihood of sheet damage or deformation occurring on the duplex pass typically depends on the material or print medium of the sheet, so here again it is possible to set a unique simplex and duplex threshold for each material or print medium type. In addition, it is possible to vary the predetermined criterion based on defect location within the sheet S (e.g. leading edge, trailing edge, middle of sheet), or based on the type of defect (e.g. dog-ear, waviness, or curl). In this regard, it will be noted that a higher threshold criterion for trailing edge defects and/or for waviness on a side edge of the sheet S may be tolerated because these are less likely to cause a sheet jam. Thus, unlike prior art systems in which the same rejection criterion is applied regardless of the printing application or printing parameters, the system of the present invention is able to be optimized according to variable applications and requirements. In other words, having one or more variable criteria provides a system which is adaptable depending on the application.

At least one second sensor 28 for sensing the surface geometry or topology of the sheet S located within the image forming unit 9 can be used to provide feedback or correlation data I' to the sentry unit 21 or to the controller 24 to increase the accuracy of the measurement of the sheet deformation D. Various parameters affecting the simulated transport conditions via the sheet conveyor mechanism 23 in the sentry unit 21 can be changed using this feedback signal to optimize the prediction result. Several sensing or measurement techniques can be used to sense or measure sheet deformation D. A two-dimensional (2D) laser triangulation sensor can create a three-dimensional (3D) sheet image when the sheet S passes the first and/or second sensor devices 22, 28. The second sensor device 28 used to provide feedback data does not necessarily need to be identical to the first sensor device 22 used within the sentry unit 21. A one-dimensional (1D) sheet height sensor using a collimated light sheet can be used to measure the sheet profile perpendicular to the direction of travel along the transport path P. In addition to improving the accuracy of the sensing unit 21, the feedback system via the second sensor device(s) 28 can be used for optimizing system productivity. In this regard, too many sheets will be rejected if the pre-set defect criteria are too sensitive, while too much print quality degradation and/or too many sheet jams will occur if the pre-set defect criteria are not sensitive enough. Accordingly, the sheet rejection threshold can be optimized using the second measurement on the print belt 3', especially in situations where the sheet deformation D changes between sentry unit 21 and image forming unit 9.

Transport Mechanism

Although not specifically illustrated in the drawings, the transport mechanism 2 in the fixing and drying unit 11 comprises a conveyor body 3 formed as a generally cylindrical drum member, which in this example has a diameter of about 1 meter. An outer periphery or circumference of the drum member 3 forms a carrier surface for supporting the plurality of sheets S delivered to the fixing and drying unit 11 from the image forming device 9. The drum is configured to rotate about its central axis and thus conveys the sheets S supported on the carrier surface further along the transport path as it rotates. To hold the sheets S fixed in position on the drum, the carrier surface includes an array of holes or perforations (not shown) which are distributed over the periphery of the drum member and the transport mechanism 2 further includes a large centrifugal fan (not shown) arranged within the drum 3. The fan acts as a suction means by generating an air-flow from outside into the drum member through the holes or perforations in the carrier surface. In this way, the fan generates an under-pressure at the carrier surface and when the sheets S are delivered to the transport mechanism 2, they are sucked onto and firmly held on the carrier surface via this under-pressure. The drum member 3 is preferably also heated to assist drying and fixing of the ink deposited on the sheets S with the sheets typically undergoing the drying and fixing process during one rotation of the drum member 3.

As described in detail above, the printing system 1 of this embodiment includes a sentry unit 21 for sensing any defects or deformations D in the sheets S as they travel along the transport path P towards the printing heads of the inkjet marking devices 91-94 in the image forming unit 9. If the processor 25 then determines that one or more of the deformations D by detected and classified render some of the sheets S unsuitable for printing, the controller 25 effects removal of the sheets S from the transport path P to prevent those sheets progressing to the inkjet marking module 9 via the ejector device 26. Importantly, however, this has the result that the rate of delivery of printed sheets to the fixing and drying unit 11 from the inkjet marking module 9 is not always constant. Where one or more sheets S have been removed from the transport path P by the ejector device 26 due to defects D, there will be a gap or delay before the following (non-defective) sheets S arrive. To have an optimum level of suction at the carrier surface of the drum member 3 in the transport mechanism 2 of the fixing and drying unit 11, therefore, it is necessary to adjust the airflow and under-pressure generated by the centrifugal fan as the rate of delivery of the sheets S changes. In particular, it is important to prevent wrinkles or cockling forming in the sheets due to an inappropriate suction level.

With the present invention, therefore, if one or more sheets S are removed from the transport path by the ejector device 26, the processor 25 of the controller 24 is configured to determine or calculate a change in the delivery of the sheets S to the drum member 3 in the transport mechanism 2 of the fixing and drying unit 11 and, based on this change, the controller 24 regulates operation of the fan in advance to adjust the under-pressure at the carrier surface to the changed conditions. In particular, the processor 25 is able to estimate the future coverage of the carrier surface of the drum member 3 by the plurality sheets S and to regulate operation of the centrifugal fan so as to adjust the under-pressure based on that estimated future coverage. In other words, the fan speed can be reduced or increased based on knowledge of the present and future sheet coverage. If both the present and expected (future) sheet coverage is greater than a given threshold (e.g. 9 sheets of A4 equivalent size), the vacuum fan setting may be reduced by a predetermined amount. For each of the sheets S, a number of sheet attributes may be taken into account by the processor 25 including:

sheet size, sheet mass or density, total ink coverage, sheet material, etc. These attributes are input by an incrementing sheet counter given a fixed time (up to 5 seconds) before a sheet S reaches the drum entrance. The maximum reduction in fan speed is preferably based on the fan ramp-up time (e.g. 100 Hz in 20 s) and a minimum travel time of the sheet between sentry unit 21 and an input or inlet to the transport mechanism 2 at the drying and fixing unit 11 (e.g. 2.6 seconds). Thus, 2.6 sec×(100 Hz/20 sec)=13 Hz. An alternative solution may be to increase the sheet counter 5 seconds before arrival and then to correct accordingly, i.e. to decrease the sheet counter if sheets are ejected 2.6 seconds before arrival at the drum 3. This solution is advantageous for the temperature controller (e.g. providing a 5 second lead time for the temperature control, 2.6 seconds for the pressure control) but may be more complicated to implement. In addition to avoiding wrinkles or cockling in the sheets S, the control of the fan based on changes in the delivery of the sheets S to the drum 3 and/or a projected coverage of the drum 3 provides a lower overall energy consumption as well as a lower noise level and longer fan life.

Figure 6:
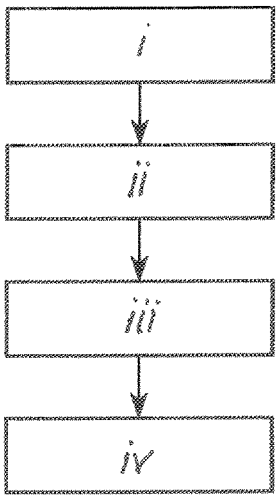
FIG. 6 is a flow diagram which schematically illustrates a method according to a preferred embodiment.

Finally, referring now to FIG. 6 of the drawings, a flow diagram is shown that schematically illustrates the steps in a method of transporting sheets S of print medium in a printing system 1 according to the preferred embodiment of the invention described above with respect to FIGS. 1 to 5. In this regard, the first box i of FIG. 6 represents the step of supporting a plurality of sheets S of paper or other print medium on a conveyor body 3 and moving the conveyor body 3 to convey the sheets S along the along a transport path P of the printing system 1. In this regard, the conveyor body 3 is preferably configured as a drum and an outer periphery of the drum forms a carrier surface for supporting the sheets S in series. The second box ii represents the step of operating a suction means to generate an under-pressure adjacent or at the conveyor body 3 to hold the plurality of sheets S fixed in position on the carrier surface of the conveyor body 3 as it conveys the plurality of sheets S along the transport path P. In particular, the suction means comprises one or more fan (e.g. a large centrifugal fan) for generating an under-pressure within the drum. As the carrier surface includes an array of perforations or holes around the outer periphery of the drum and communicating with an interior of the drum, the under-pressure generated within the drum acts via the perforations or holes to hold the sheets S fixed in position supported on the carrier surface. The third box iii then represents the step of determining or ascertaining the rate of delivery of the sheets S to the conveyor body 3, and especially a change in the rate of delivery of the sheets S to the conveyor body 3. For example, where the printing system 1 includes an apparatus 20 for detecting defects or deformations D in the sheets S and removing or ejecting sheet S from the transport path P that are assessed or determined as unsuitable for printing, the processor 25 is configured to calculate or determine a corresponding change in the delivery rate of the sheets S to the conveyor body 3 caused by the removal of the defective sheets. The final box iv in drawing FIG. 6 then represents the step controlling or regulating operation of the suction means (e.g. centrifugal fan) to adjust or modify the under-pressure generated based on the rate of delivery of the plurality of sheets S to the conveyor body 3, and particularly based on the determined or ascertained change in the rate of delivery of the sheets S to the drum. In this way, the under-pressure or suction can be adjusted to prevent wrinkles or "cockling" in the sheets S, especially on the transport mechanism 2 of the drying and fixing unit 11 after a printing in the image forming unit 9. In addition, the controller 24 is able to ensure a longer service life of the fan, as well as a lower noise level and lower overall energy consumption.

Although specific embodiments of the invention are illustrated and described herein, it will be appreciated by those of ordinary skill in the art that a variety of alternate and/or equivalent implementations exist. It should be appreciated that the exemplary embodiment or exemplary embodiments are examples only and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Generally, this application is intended to cover any adaptations or variations of the specific embodiments discussed herein.

It will also be appreciated that in this document the terms "comprise", "comprising", "include", "including", "contain", "containing", "have", "having", and any variations thereof, are intended to be understood in an inclusive (i.e. non-exclusive) sense, such that the process, method, device, apparatus or system described herein is not limited to those features or parts or elements or steps recited but may include other elements, features, parts or steps not expressly listed or inherent to such process, method, article, or apparatus. Furthermore, the terms "a" and "an" used herein are intended to be understood as meaning one or more unless explicitly stated otherwise. Moreover, the terms "first", "second", "third", etc. are used merely as labels, and are not intended to impose numerical requirements on or to establish a certain ranking of importance of their objects.

The invention claimed is:

1. A printing system comprising a transport mechanism for transporting sheets of a print medium in a printing system, comprising:

a conveyor body for supporting a plurality of sheets of a print medium thereon, wherein the conveyor body is movable to convey the sheets along a transport path in the printing system;

a suction device configured to generate an under-pressure at or adjacent to the conveyor body to hold the plurality of sheets fixed in position thereon as the conveyor body conveys the plurality of sheets along the transport path; and a controller for controlling or regulating operation of the suction device to adjust the under-pressure generated, wherein the controller is configured to control operation of the suction device based on delivery of the plurality of sheets to the conveyor body and/or a change in the delivery of the sheets to the conveyor body.

2. The printing system according to claim 1, wherein the delivery of the plurality of sheets to the conveyor body or the change in the delivery of the sheets to the conveyor body is determined upstream of the conveyor body in the printing system.

3. The printing system according to claim 1, wherein the controller is configured to estimate a future coverage of the conveyor body with the plurality sheets and to control operation of the suction device to adjust the under-pressure according to the estimated future coverage.

4. The printing system according to claim 1, wherein the controller is configured to control operation of the suction device to adjust the under-pressure at or adjacent to the conveyor body before delivery of the plurality of sheets to the conveyor body.

5. The printing system according to claim 1, wherein the conveyor body defines a carrier surface configured to support the plurality of sheets arranged in series on the conveyor body, and wherein the conveyor body includes holes or perforations which are at least partially covered by the plurality of sheets supported on the carrier surface, the holes or perforations being configured and arranged to impart or communicate the under-pressure generated by the suction device to the carrier surface to hold the plurality of sheets fixed in position thereon.

6. The printing system according to claim 1, wherein the conveyor body is provided as a drum member which is configured to support the plurality of sheets around a periphery or a circumference thereof, whereby an inner or outer periphery or circumference of the drum forms the carrier surface for the plurality of sheets, wherein the drum is configured to rotate about a central axis to convey the sheets along the transport path; or wherein the conveyor body is provided as a belt member which is configured to support the plurality of sheets over a substantially planar surface thereof, wherein the belt member is adapted to be moved by rollers to convey the sheets along the transport path.

7. The printing system according to claim 1, wherein the suction device is a fan, and the controller is configured to regulate an operating speed of the fan to adjust the under-pressure generated, the operating speed preferably being continuously variable between a maximum and a minimum value, wherein the controller is configured to increase the operating speed of the fan based on a decrease in the rate of delivery of the plurality of sheets to the conveyor body and/or a lower estimate of a future coverage of the conveyor body.

8. The printing system according to claim 1, wherein the controller is configured to regulate operation of the suction device based on one or more parameters of the plurality of sheets selected from the group comprised of: sheet size, sheet mass, sheet density, total ink coverage of each sheet, sheet type or shape, and print medium.

9. A method of transporting sheets of print medium in a printing system, comprising:

supporting a plurality of sheets of a print medium on a conveyor body that is movable to convey the sheets along a transport path in the printing system;

operating a suction device to generate an under-pressure adjacent or at the conveyor body to hold the plurality of sheets fixed in position thereon as the conveyor body conveys the plurality of sheets along the transport path; and controlling operation of the suction device to adjust or modify the under-pressure generated based on a rate of delivery of the plurality of sheets to the conveyor body and/or a change in the rate of delivery of the sheets to the conveyor body.

10. The method according to claim 9, comprising determining the rate of delivery of the plurality of sheets to the conveyor body, or the change in the rate of delivery of the sheets to the conveyor body, upstream of the conveyor body in the printing system.

11. The method according to claim 9, wherein the controlling step comprises estimating a future coverage of the conveyor body with the plurality sheets and regulating an operating speed of the suction device to adjust the under-pressure according to the estimated future coverage, and particularly before arrival or delivery of the plurality of sheets to the conveyor body.

12. The method according to claim 9, wherein the conveyor body is provided as a drum member configured to support the plurality of sheets around a periphery or a circumference thereof, whereby an inner or an outer periphery or circumference of the drum carries the plurality of sheets, and whereby the drum rotates about a central axis to convey the sheets along the transport path.

13. The method according to claim 9, wherein the step of controlling the operation of the suction device is based on one or more parameters of the plurality of sheets selected from the group of: sheet size, sheet mass, sheet density, total ink coverage of each sheet, sheet type or shape, and type of print medium.

14. The method according to claim 9, further comprising controlling movement, and especially speed, of the conveyor body based on a rate of delivery of the plurality of sheets to the conveyor body and/or based on a change in the rate of delivery of the sheets to the conveyor body.

* * * * *